US010265594B1

(12) United States Patent
Hamel

(10) Patent No.: US 10,265,594 B1
(45) Date of Patent: Apr. 23, 2019

(54) MODIFIED HOCKEY STICK

(71) Applicant: Betsy Hamel, Coral Springs, FL (US)

(72) Inventor: Betsy Hamel, Coral Springs, FL (US)

( * ) Notice: Subject to any disclaimer, the term of this patent is extended or adjusted under 35 U.S.C. 154(b) by 0 days.

(21) Appl. No.: 15/972,343

(22) Filed: May 7, 2018

(51) Int. Cl.

| | |
|---|---|
| ***A63B 67/14*** | (2006.01) |
| ***A63B 43/00*** | (2006.01) |
| ***A63B 24/00*** | (2006.01) |
| ***A63B 71/06*** | (2006.01) |
| ***A63B 59/70*** | (2015.01) |
| ***A63B 69/00*** | (2006.01) |
| *A63B 102/24* | (2015.01) |
| *A63B 102/22* | (2015.01) |

(52) U.S. Cl.
CPC ..... *A63B 59/70* (2015.10); *A63B 69/0024* (2013.01); *A63B 24/0021* (2013.01); *A63B 43/00* (2013.01); *A63B 67/14* (2013.01); *A63B 71/06* (2013.01); *A63B 2102/22* (2015.10); *A63B 2102/24* (2015.10)

(58) Field of Classification Search
CPC .. A63B 2102/22; A63B 2102/24; A63B 59/70
USPC ..... 473/560–563, 446
See application file for complete search history.

(56) References Cited

U.S. PATENT DOCUMENTS

| | | | | |
|---|---|---|---|---|
| 3,377,065 A * | 4/1968 | White, Sr. | A63B 59/70 473/563 |
| 3,529,825 A * | 9/1970 | White, Sr. | A63B 59/70 473/446 |
| 4,218,062 A * | 8/1980 | Brooks, Jr. | A63B 21/0618 273/108 |
| 5,174,567 A * | 12/1992 | Nordstrom | A63B 15/00 473/230 |
| 5,685,792 A * | 11/1997 | Ruoff | A63B 59/70 473/563 |
| 6,183,384 B1 * | 2/2001 | Roberto | A63B 60/50 473/563 |
| 6,234,923 B1 * | 5/2001 | Gentile | A63B 59/70 473/563 |

* cited by examiner

*Primary Examiner* — Mark S Graham
(74) *Attorney, Agent, or Firm* — Sanchelima & Associates, P.A.; Christian Sanchelima; Jesus Sanchelima

(57) ABSTRACT

A modified hockey stick comprises a handle and a blade. The blade comprises at least one opening configured in the bottom surface of the blade. The at least one opening extends in an upward direction within the blade of the modified hockey stick. The opening is configured to receive a shank of a wheel for supporting rolling movement of the modified hockey stick on a playing surface.

11 Claims, 2 Drawing Sheets

MODIFIED HOCKEY STICK

BACKGROUND OF THE INVENTION

1. Field of the Invention

The present disclosure generally relates to hockey equipment used for street hockey or roller hockey. More particularly, the present disclosure relates to a modified hockey stick designed to help both new and seasoned hockey players improve their stick handling abilities thereby improving their game.

2. Description of the Related Art

Stick handling is a fundamental skill required to excel in the game of hockey. For ice hockey, once a player learns to skate, he/she must then learn to maneuver the stick to effectively control the puck. Although this part of the learning process seems easy, most players end up wielding the stick incorrectly leading to reduced range of motion and added stress to the player. In the initial stages of learning the game, this can be prevented from turning habitual. A stick, which is easily moved, light, and flexible, is required. Another aspect of playing hockey is that the stick must always be supported and moved along with the player on the playing surface. Carrying a stick can become tiring for children and those who are still increasing the strength of their upper extremities. As a result, "stick handling" is often "stick dragging" for novice players. Even for seasoned players, effortless and agile movement with conventional hockey sticks is not always possible. A stick, which is easy to maneuver by players of all ages and skill levels, is therefore required.

Hence, there is a long felt but unresolved need for a stick, which is easily moved, light, and flexible. Furthermore, there is a need for a stick, which is easy to maneuver by players of all ages.

SUMMARY OF THE INVENTION

The invention, disclosed herein, addresses the above-mentioned need for a stick, which is easily moved, light, and flexible. Furthermore, the invention addresses the need for a stick, which is easy to maneuver by players of all ages and skill levels.

It is an object of the invention to provide a stick that helps children or others learning to play the game of hockey with a stick that is easier to handle than a conventional hockey stick.

It is another object of the invention to provide a stick with improved handling for both experienced and novice players. Such a stick is usable in multiple versions of hockey, for example, field hockey, ice hockey, roller hockey, underwater hockey, etc.

The modified hockey stick, disclosed herein, comprises a handle and a blade. The blade comprises at least one opening configured in the bottom surface of the blade. The at least one opening extends in an upward direction within the blade of the modified hockey stick. The opening is configured to receive a shank of a wheel for supporting rolling movement of the modified hockey stick on a playing surface.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
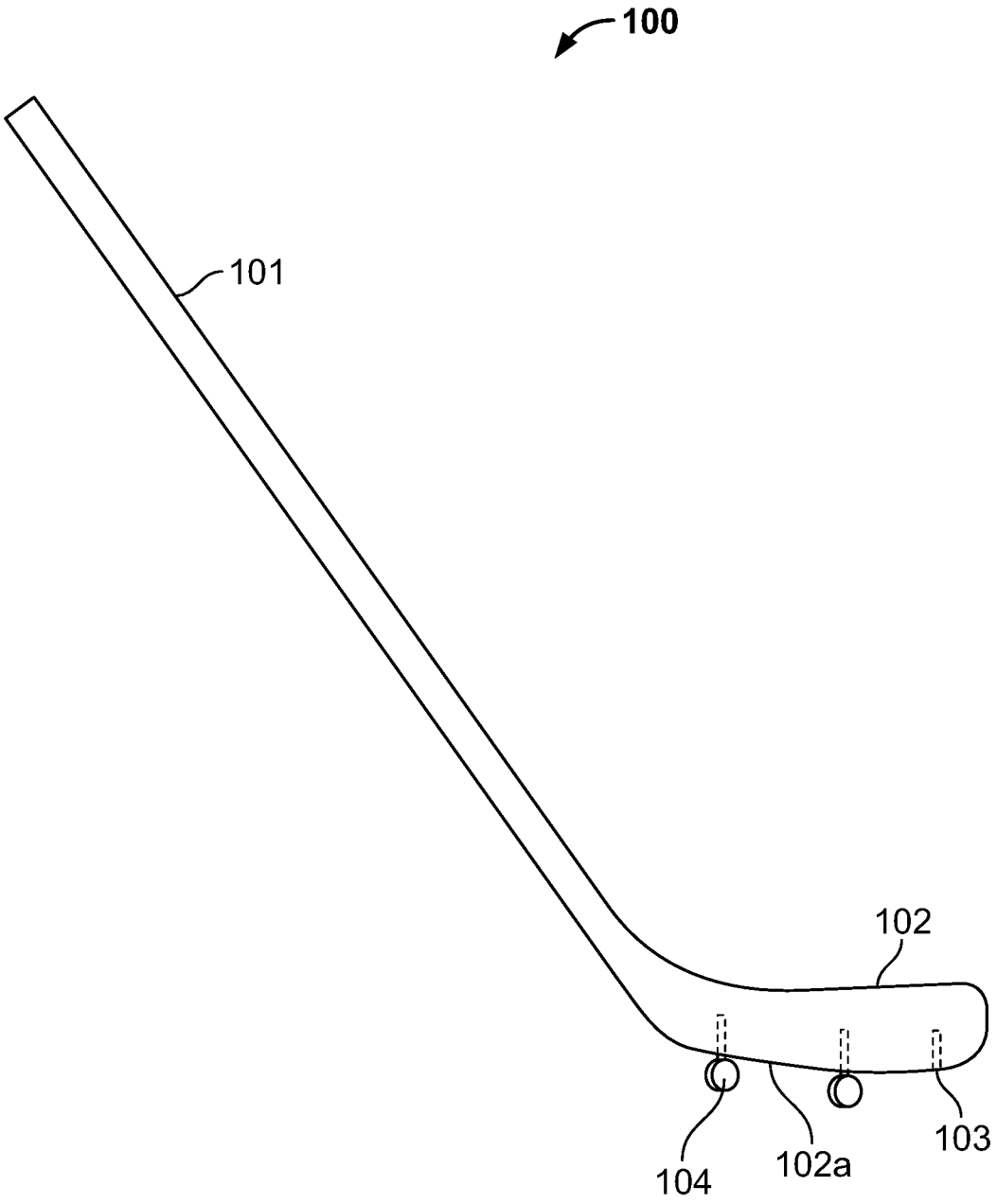
FIG. 1 exemplarily illustrates a front elevation view of a modified hockey stick.

FIG. 1 exemplarily illustrates a front elevation view of a modified hockey stick 100. The modified hockey stick 100, disclosed herein, comprises a handle 101 and a blade 102. The blade 102 comprises at least one opening 103 configured in the bottom surface 102*a* of the blade 102. The at least one opening 103 extends in an upward direction within the blade 102 of the modified hockey stick 100. The opening 103 is configured to receive a shank of a wheel 104 for supporting rolling movement of the modified hockey stick 100 on a playing surface. In an embodiment, three openings 103 are configured within the bottom surface 102*a* of the blade 102 as exemplarily illustrated in FIGS. 1-2. The small swivel wheels 104 at the bottom surface 102*a* of the blade 102 of the modified hockey stick 100 ensures smooth rolling movement over several types of terrain, for example, concrete, asphalt, etc., to swivel and have a smooth effect on the ground. In an embodiment, there may be two or three wheels 104.

In an embodiment, the modified hockey stick 100 can be used for training purposes for adults and kids, roller hockey (or a new type of roller hockey if the size of the blade must change.) Further, the modified hockey stick 100 helps to practice or play roller hockey, ice hockey/practice. The swivel wheels 104 maintain balance and swivel as to not ruin the blade 102 and help with the movement and balancing of the modified hockey stick 100. The modified hockey stick 100 prevents the hockey blade 102 from sticking or getting ruined on the ground or ice. Alternately, the modified hockey stick 100 can be used by players of medium to advanced skill levels. For such players, the modified hockey stick 100 helps with smoother movement and improving their existing skillset. In another embodiment, the length of the modified hockey stick 100 is adjustable in size according to the player. The modified hockey stick 100 is made of materials, for example, fiberglass, wood, etc. In an embodiment, the swivel wheels 104, very small, are made of rubber.

Figure 2:
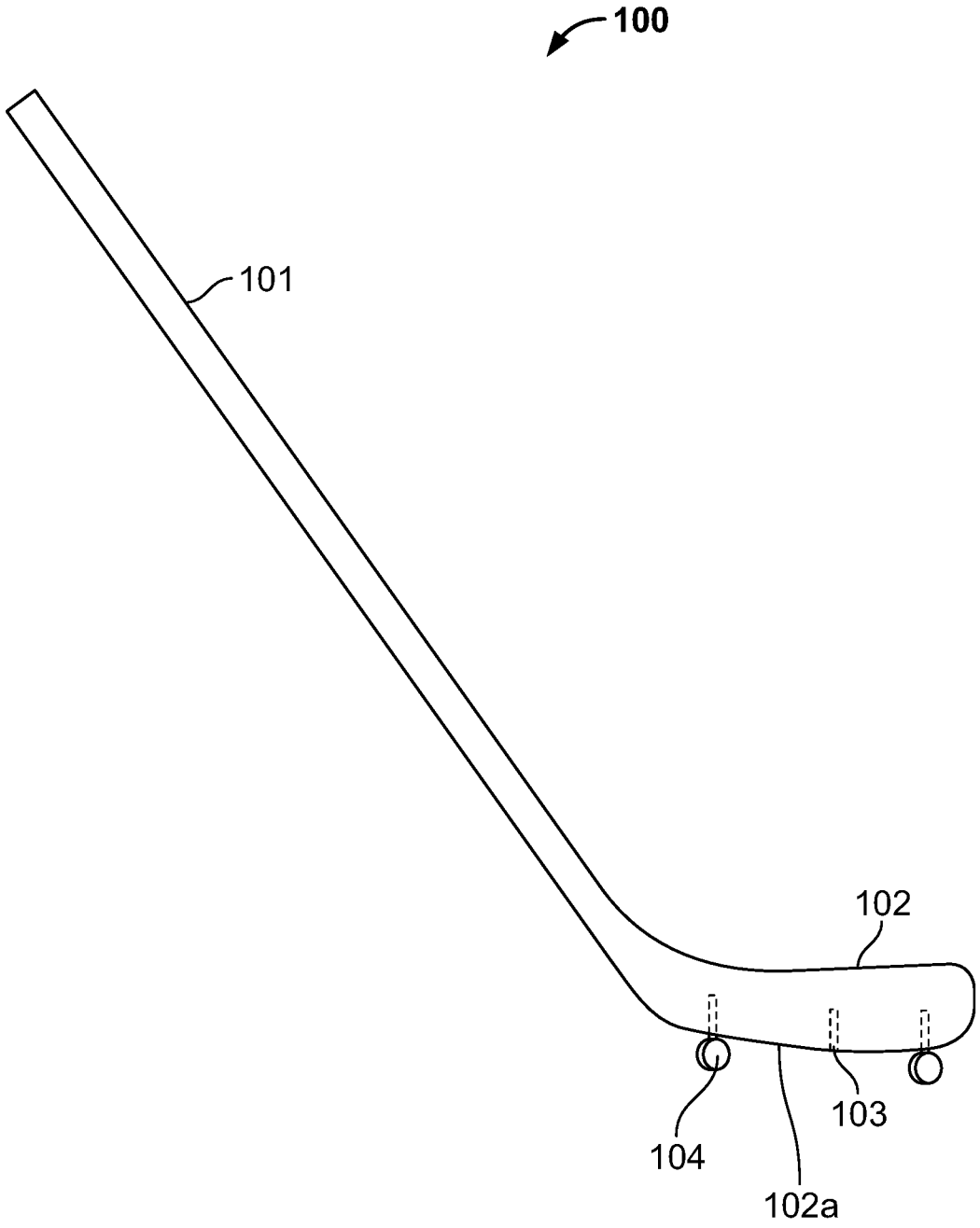
FIG. 2 exemplarily illustrates a front elevation view of a modified hockey stick.

FIG. 2 exemplarily illustrates a front elevation view of a modified hockey stick 100. To increase the ease of moving the modified hockey stick 100, the present invention provides support wheels 104 or castors for moving the modified hockey stick 100 along the playing surface. The playing surface is, for example, a solid surface, such as a field or street, in the case of land hockey, or a sheet of ice in the case of ice hockey. In either case, the purpose of the modified stick is to provide the player with some additional support and assistance in moving the modified hockey stick 100. As shown in the attached drawings, the modified hockey stick 100 is adapted to include several wheels 104 or castors along the bottom surface 102*a* of the blade 102 of the modified hockey stick 100. In the illustrated embodiment, the modified hockey stick 100 includes two openings 103 on the bottom surface 102*a* of the blade 102. The openings 103 extend into the blade 102 of the modified hockey stick 100, to receive the shank or other base member of a wheel 104 or a castor within the openings 103. As a result, the wheel 104 extends from the bottom surface 102*a* of the blade 102 of the modified hockey stick 100 and rolls along the playing surface as it is carried by the player.

Although the illustrated embodiment shows the use of the two wheels 104, which can be moved between several mounting positions along the blade 102 of the modified hockey stick 100. A single wheel 104 or more than two wheels 104 might also be used. The position of the wheel 104 or wheels 104 may be in any location desired by the player, to accommodate the height of the player, or the comfort of the modified hockey stick 100 with the wheels 104 in the available wheel positions. It should be clear that the size of the wheels 104 are relatively small, to avoid interference with the ability of the blade 102 of the modified hockey stick 100 to hit either a ball or a puck. Likewise, the blade 102 of the modified hockey stick 100 has a sufficient width to accommodate one or more openings 103 for securing the wheels 104 or castors. In the illustrated embodiment, a conventional castor-like wheel is used, which can be locked into the opening 103 provided within the blade 102, and to rotate and move in any direction on the playing surface. Using a castor of this type enables the player to move in any direction and have the modified hockey stick 100 respond without resistance. Alternative wheels 104 might also be used, for example, providing a single axis wheel partially extending from the bottom surface 102*a* of the blade 102. However, such wheels 104 may have the limitation of fully directional rolling movement to follow the player's movements without resistance.

The modified hockey stick 100 is preferably a conventional handle material construction, and is also provided with a conventional plastic, fiberglass, or wood blade construction, any of which would enable openings 103 formed in the bottom surface 102*a* of the blade 102 and extending into the body of the blade 102 as exemplarily illustrated in FIG. 1-2. The modified hockey stick 100 can be used in different versions of hockey, for example, field hockey, street hockey, roller hockey, underwater hockey, etc. The modified hockey stick 100 can be manufactured in varied sizes depending on the requirement of the version of the sport. Furthermore, players of all sizes and ages can use the modified hockey stick 100 irrespective of their skill levels.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A hockey stick, comprising:

a handle mounted to a blade having at least one vertical slit, said blade having a bottom surface, said at least one vertical slit has a height and a width, said height is greater than said width, said at least one vertical slit creates an opening on said bottom surface and extends inside and to the center of the blade, one shank inserted into each of said at least one vertical slit, said shank having a shank height and a shank width, said shank height being greater than said shank width, said shank having a bottom distal end, at least one wheel member mounted to said bottom distal end; each of said at least one wheel member is entirely below said bottom surface and configured to travel along a ground surface.

2. The hockey stick of claim 1 wherein said handle is integrally mounted to said blade.

3. The hockey stick of claim 1 wherein said handle is removably mounted to said blade.

4. The hockey stick of claim 1 wherein said handle is mounted to said blade at an obtuse angle.

5. The hockey stick of claim 1 wherein said blade has a blade height, said at least one slit extends until the middle of said blade height.

6. The hockey stick of claim 1 wherein said at least one slit is two slits and said at least wheel member is two spaced apart wheel members inserted into each of said two slits.

7. The hockey stick of claim 6 wherein said blade includes a proximal end and a distal end, one of said two spaced apart wheel members located at the proximal end and the other said of two spaced apart wheel members located at the distal end.

8. The hockey stick of claim 1 wherein said at least one wheel member is a swivel wheel.

9. The hockey stick of claim 1 wherein said at least one wheel member is a caster.

10. The hockey stick of claim 1 wherein said at least one wheel member is locked into said at least one slit using screws, clip fasteners, or an adhesive.

11. The hockey stick of claim 1 wherein said at least one wheel member is three wheels located on said bottom surface.

* * * * *